United States Patent [19]

Morosow et al.

[11] Patent Number: 4,978,126

[45] Date of Patent: Dec. 18, 1990

[54] ROTATING AMUSEMENT DEVICE

[76] Inventors: Leib Morosow; Moshe Morosow, both of 781 Eastern Parkway, Brooklyn, N.Y. 11213

[21] Appl. No.: 442,122

[22] Filed: Nov. 28, 1989

[51] Int. Cl.[5] ..... A63F 9/08

[52] U.S. Cl. ..... 273/153 S; 273/155

[58] Field of Search ..... 273/281, 153 R, 153 S, 273/155

[56] References Cited

U.S. PATENT DOCUMENTS

| | | | |
|---|---|---|---|
| 609,995 | 8/1898 | Murphy | 273/153 R |
| 3,655,194 | 4/1972 | Pierson | 273/153 S |
| 4,415,158 | 11/1983 | Engel | 273/155 |
| 4,483,535 | 11/1984 | Le Cart | 273/155 |
| 4,550,040 | 10/1985 | Fisher | 273/153 S |
| 4,580,783 | 4/1986 | Cohan | 273/155 |

FOREIGN PATENT DOCUMENTS

| | | | |
|---|---|---|---|
| 8123478 | 11/1982 | Fed. Rep. of Germany | 273/153 S |
| 3143735 | 5/1983 | Fed. Rep. of Germany | 273/153 S |
| 2538261 | 6/1984 | France | 273/153 S |
| 2116050 | 9/1983 | United Kingdom | 273/153 S |
| 8501666 | 4/1985 | World Int. Prop. O. | 273/153 S |
| 8809692 | 12/1988 | World Int. Prop. O. | 273/153 S |

OTHER PUBLICATIONS

"Group Theory, Rubik's Cube and the Avenger", *Games,* Jul. 1987, pp. 44, 45.

*Primary Examiner*—Edward M. Coven
*Assistant Examiner*—W. Pierce
*Attorney, Agent, or Firm*—Israel Nissenbaum

[57] ABSTRACT

A rotating amusement device having two or more overlapping circle members which are independently rotatable with the overlapping sections being rotatable into the bodies of any or all of the overlapping circles or into a different overlapping of circles. The device can be utilized as a puzzle wherein various possible overlapping sections are differently colored or shaped and the object is to obtain a predetermined color combination or shape configuration. The circle members are comprised of interlocking elements with a peripheral frame holding the circles in such interlocking position while permitting the independent rotation of each of the circles. Increase in the number of overlapping circles adds to the complexity by increasing the number of possible permutations.

10 Claims, 1 Drawing Sheet

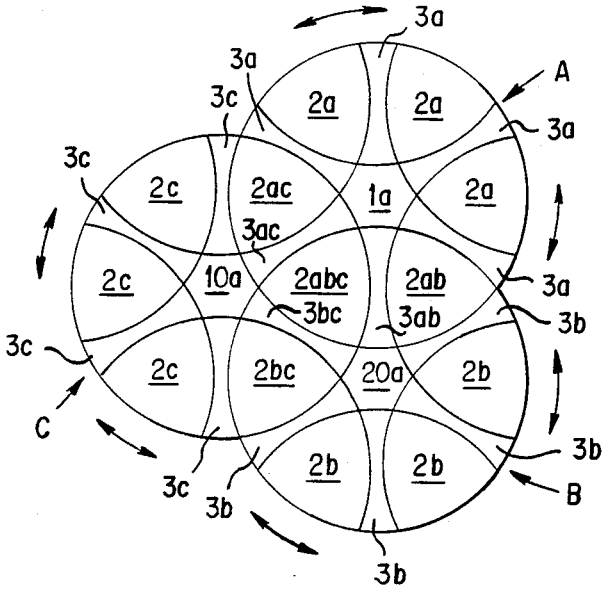
FIG. 5
FIG. 6
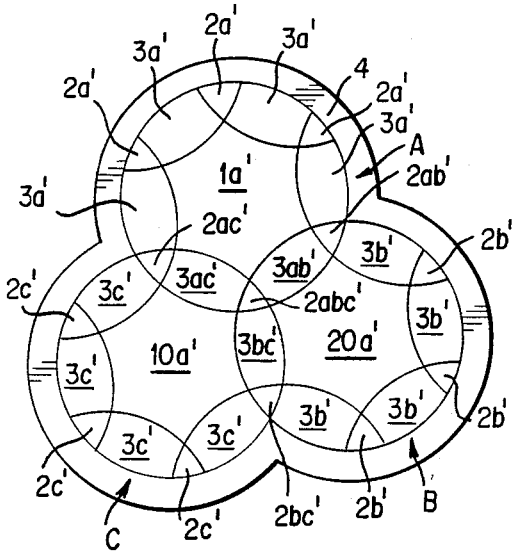
FIG. 7
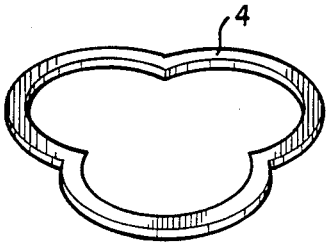
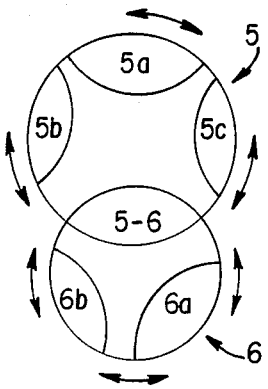
FIG. 8

ROTATING AMUSEMENT DEVICE

This invention relates to reconfigurable amusement devices used as three-dimensional puzzles and particularly to those having an interlocking relation between the elements such as in the device known as the Rubik's Cube (a trademark for a three-dimensional puzzle).

Three dimensional puzzle type amusement devices are generally of one of two types. The first type comprises completely separable elements which have a specific interlocking relation when the puzzle is solved. A second type of such amusement devices is exemplified by devices such as the Rubik's Cube, Missing Link (trademark for a three dimensional puzzle) and others of a similar nature which involve initially interlocking elements which are movable in restricted directions and planes with the objective being to match colors, designs, etc. in a predetermined fashion. Many of these latter puzzle devices have a central interlocking mechanism with the elements being movable therearound. While movements in such puzzles are in a rotational mode around a central axis, these puzzles do not utilize the specific characteristics inherent only in the circle configuration.

It is an object of the present invention to provide an amusement device puzzle in the form of interlocking overlapping circles with shareable elements.

It is a further object of the present invention to provide such interlocking circles with an outer peripheral locking frame and free internal rotational movement.

It is a still further object of the present invention to permit increase of complexity of the amusement device puzzle by the interlocked inclusion of additional rotatable circles.

These and other objects, features and advantages of the present invention will become more evident from the following discussion in which:

FIG. 5 is a top view of an embodiment of the amusement device of the present invention with three interlocking rotatable circle members of FIG. 1;

FIG. 6 is a view taken of the amusement device of FIG. 5 with the top layer removed and showing the peripheral frame member;

FIG. 7 is an isometric view of the flexible frame member for locking the circles of FIG. 5 together; and FIG. 8 is a top view of a second embodiment of the present invention showing overlapping circle members of differing sizes.

Figure 1:
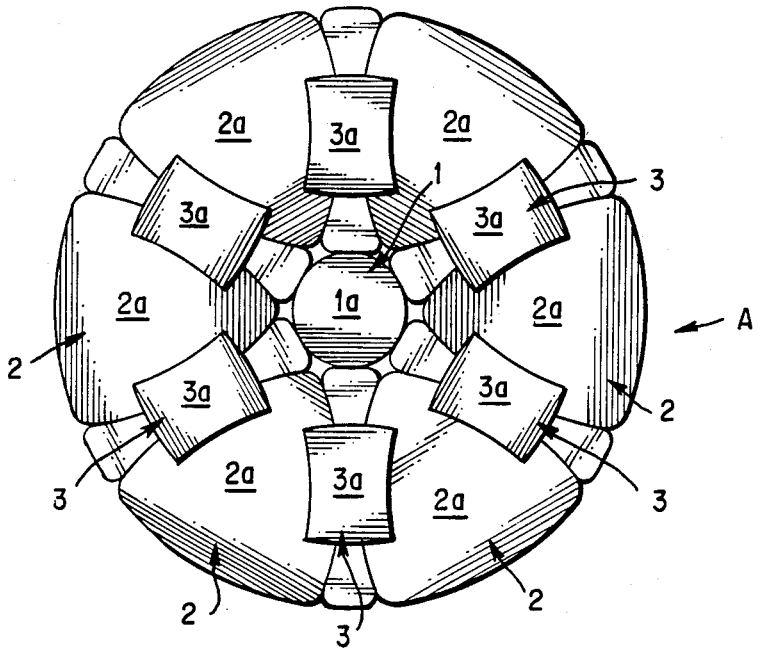
FIG. 1 is a top view of a single circle member of the amusement device of the present invention.

Generally the present invention comprises an amusement device for use as a puzzle, comprised of two or more interlocked circle members positioned along a common plane and having substantially parallel central axes. Each of the circle members is comprised of compositional elements which are rotatable around the central axis of the circle member. A portion of each of the circle members laterally overlaps a portion of at least one other circle member along the common plane whereby the overlapped circle members have compositional elements in common in the overlapping portions. Each of the circle members is independently rotatable around its own central axis, with the compositional elements of the overlapping portions being thereby rotatable into the bodies of any or all of the overlapping circles. The compositional elements can therefore be moved into a large number of positions and interrelations with other compositional elements. The device further comprises means for prevention of lateral displacement of the compositional elements along the common plane and means for prevention of axial displacement of the compositional elements.

The device can be utilized as a puzzle wherein the compositional elements of the overlapping portions are differently colored or externally shaped e.g. adorned with geometric shapes or shapes of objects such as different flowers, fruits, animals etc, and the object is to obtain a predetermined color combination or shape configuration or interrelation. The circle members are comprised of interlocking elements preferably with a peripheral frame holding the circles in a lateral interlocking position while permitting the independent rotation of each of the circles. Increase in the number of overlapping circles adds to the complexity by increasing the number of compositional elements, positions and possible permutations. In addition, the overlapping portions of obverse sides of the circle members may be independently matched in color and shape to further increase complexity.

In a preferred embodiment, the circle members are each comprised of a single fixed (i.e. not movable out of the individual circle members but optionally rotatable around its own axis in place) centerpiece or central element located at the center of the circle and extending laterally therefrom. Circle body elements (preferably six for symmetry but not limited to such number) are interlocked with the central fixed element, are rotatable therearound, and are capable of being rotationally shared with other overlapping circle members. Spacer elements, in such preferred embodiment, separate the circle body elements from each other, are shaped to be interlocked with both the body elements and fixed central element, are also rotatable around the fixed central element, and are rotationally shareable with other overlapping circles. It is the rotational permutation of the freely rotatable body elements and spacer elements (the shareable circle compositional elements), of varying colors and external shape configurations, which provide the puzzle challenge in arriving at a predetermined design or configuration by rotational manipulation.

The various circle elements are each preferably comprised of three-layered elements which are laterally adjacently complementary in shape whereby the layers of the elements are interlocked and prevented from axially falling apart. The complementary interlocked elements are further prevented from being peripherally laterally disengaged from one another by a peripheral frame member which is snugly, but not engagingly, conformed to the exposed outer periphery of the overlapping circles. The peripheral frame member is however sufficiently loose at the periphery of the circles to permit free rotation of the circles therewithin. Removal of the frame member permits further lateral complementary engagement with additional circles with a different size and shaped frame thereafter being required. Depending upon the original size and disposition of the previous circles, additional circles may be overlappingly engaged with more than two of the original circles.

A preferred embodiment of three-layered interlocked complementary elements comprises a first element having upper and lower layers larger than the central connecting portion, a second element having upper and lower layers smaller than a central connecting portion layer, and a third element having upper and lower layers with the central connecting layer being both larger and smaller than the upper and lower layers in different extending direction. The layers of each of the elements complement each other when laterally engaged and are accordingly axially interlocked and held in place by an outer peripheral frame member. The upper and lower layers of each of the various elements need not be congruent and may differ in size and shape provided that all the complementary portions of a single layer form circles, with each having a common axis with circles in the center and on the obverse side.

The peripheral frame member is preferably complementary engaged with the exposed periphery of the central layer of the complementary three-layer elements whereby it is prevented from becoming axially disengaged from the circles. An advantage of such frame configuration is the peripheral exposed edges of the circles for facilitated manual rotation of the overlapping circle members. The frame member may either peripherally surround any or all of the layers of the overlapping circles providing that it prevent lateral disengagement of the elements.

An example of a peripheral frame member is a shaped metal or hard plastic member conformed to the exposed periphery of the central layer and having a hinge and latching element for proper emplacement. Alternatively, the frame member may be placed around the central layer prior to emplacement of either the upper of lower layers whereby it is sandwiched therebetween.

It is preferred, that the overlapping areas and their shared compositional elements have curved peripheral edges conforming to the curvature of the overlapping circles. The compositional elements are thereby freely moveable between the circles with the peripheral edges being capable of forming part of the circle circumference to which it is moved. It is also preferred that the compositional elements of the overlapping areas have only curved ends since sharp edges may tend to impede rotational sharing, of the compositional elements, among the various overlapping circles.

It is understood that a partial or incomplete movement of one compositional element will impede movement of a second compositional element resulting in a locking-up of the puzzle. Rotational movement of some or all of the overlapping circles is impeded and this is an aspect of the device whereby an exactitude of movement is required for properly solving a configurational puzzle.

With specific reference to the drawings, circle member A, as shown in FIG. 1, is comprised of a central fixed or centerpiece element 1, six substantially triangular compositional body elements 2 and six compositional spacer elements 3. As more clearly seen in FIGS. 2A–4B, all of the elements are comprised of three layers which are laterally complementary in configuration for interlocking engagement.

Figure 2A:
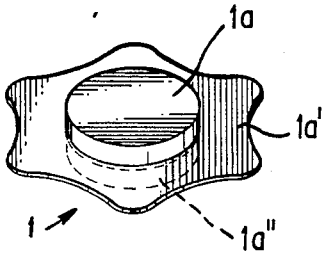
FIG. 2A is an isometric view of the central fixed element of the circle member of FIG. 1.
Figure 2B:
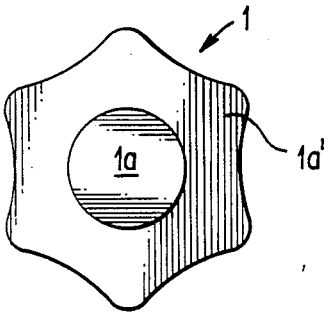
FIG. 2B is a top view of the central fixed element of FIG. 2A.
Figure 3A:
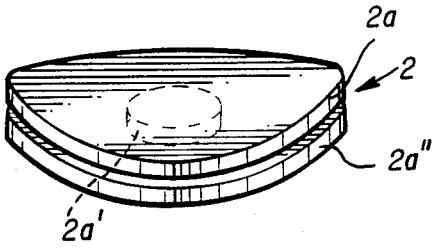
FIG. 3A is an isometric view of one of the shareable compositional elements of the circle member of FIG. 1.
Figure 3B:
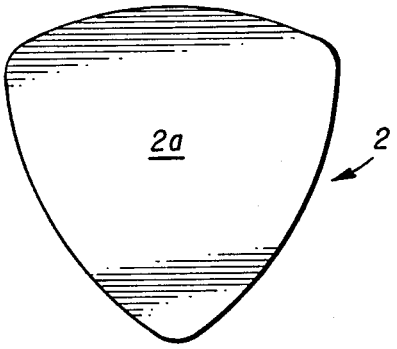
FIG. 3B is a top view of the compositional element of circle member of FIG. 3A.
Figure 4A:
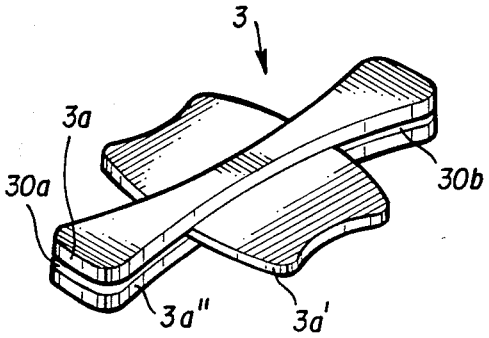
FIG. 4A is an isometric view of a second shareable or spacing compositional element of the circle of FIG. 1.
Figure 4B:
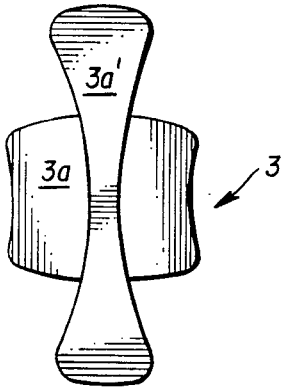
FIG. 4B is a top view of the shareable compositional element of FIG. 4A.

Circle members A, B and C, in FIGS. 5 and 6, of identical dimensions, each have identical central fixed elements 1, 20 and 10 respectively, exemplified as follows by reference to element 1 in FIGS. 2A and 2B. Element 1 comprises upper and lower layers 1*a* and 1*a*″, in the form of button-like extensions (preferably identical in size and configuration) and a centrally located outwardly extending layer or skirt section 1*a*′. The body of each of the circles A, B, C in FIGS. 5 and 6 is comprised of six substantially triangular shaped elements 2 with the sides thereof being curved with an arc corresponding to the curvature of the circumference of the circles (elements 2 are identical in all the circles). As exemplified by unshared triangular element 2 in circle A, FIGS. 3A and 3B show that each of the triangular shaped elemetns is comprised of upper and lower congruent triangular layers 2*a* and 2*a*″ centrally connected by a short rod layer 2*a*′. Between adjacent triangular shaped elements 2 in circles A, B, C is a spacer element 3 comprising (as exemplified by an unshared spacer element in circle A) as shown in FIGS. 4A and 4B, two elongated layers 3*a* and 3*a*″ congruent with each other and connected to each other by a third outwardly extending elongated layer 3*a*′ sandwiched therebetween and perpendicular to the first two layers. The third elongated layer 3*a*′ is sized to extend outwardly from the sandwich formed by the first two layers 3*a* and 3*a*″. The third layer is further sized to provide equally dimensioned spacings 30*a* and 30*b*, between the first two elongated layers 3*a* and 3*a*″ at the sides of the third layer 3*a*′.

Each circle, such as circle A (with corresponding elements for circles B and C) is formed by alternately interfitting the triangular elements 2 and spacer elements 3 on the outwardly extending skirt section 1*a*′ of the central fixed element 1. The upper and lower triangular layers 2*a* and 2*a*″ of the triangular elements 2 overlap opposite sides of the skirt section 1*a*′ which is snugly, though laterally movably, inserted into the space between the upper and lower layers 2*a* and 2*a*″. A spacer element 3 is positioned between every adjacent pair of triangular elements 2 with the skirt section 1*a*′ of the central fixed element 1 being similarly inserted within dimensioned spacing 30*a*. The third elongated extending layer 3*a*′ is inserted into the spacing between the upper and lower triangular layers 2*a* and 2*a*″ of the adjacent triangular elements 2, as is more readily evident from FIG. 6. A second circle is integrated with a first circle, e.g. second circle B with first circle A, by inserting a skirt section 20*a*′ of the central fixed element 20 of circle B into the open second dimensioned spacing 30*b* of a spacer element 3, shown with layer 3*ab* in FIG. 5, with the first spacing 30*a* being in engagement with skirt section 1*a*′ of central fixed element 1 of circle A. Triangular layers 2*abc* and 2*ab*, adjacent spacer layer 3*ab*, of circle A are also interfitted onto skirt section 20*a*′ of central fixed element 2 of circle B. The remainder of circle B is then constructed as was circle A with the alternating additions (with reference to the clockwise direction in FIG. 5) of additional spacer element 3 with layer 3*b*, triangular element 2 with layer 2*b*, spacer element 3 with layer 3*b*, triangular element 2 with layer 2*b*, spacer element 3 with layer 3*b*, triangular element 2 with layer 2*b*, spacer element 3 with layer 3*b*, triangular element 2 with layer 2*bc* and spacer element 3 with layer 3*bc* to complete the circle.

As shown in FIG. 5, third circle C is interlocked with circles A and B by interfitting the skirt section 10*a*′ of center fixed element 1 of circle C with spacer element layer 3*ac* and adjacent triangular element layers 2*ac* and 2*abc* and spacer element 3*bc* and adjacent triangular element 2*bc*. (In other embodiments a circle may be simply overlapped with one circle or, if allowed by geometry and space, with more than two other circles.) Alternating spacer elements 3 with layers 3*c* and triangular elements 2 with layers 2*c* complete circle C. With the completion of the desired number of overlapping circles, frame member 4 shown in FIG. 7, adapted to conform to the exposed outer periphery of the overlapping circles is placed around circles A, B and C. As shown in FIG. 6, frame member 4 fits within the exposed unfilled spacings of triangular elements 2 with layers 2*a*, 2*b*, 2*c* and spacer elements 3 with layers 3*a*, 3*b* and 3*c*. The frame member 4 prevents the lateral disengagement of the interfitted elements but permits rotation of circles A, B and C in the direction shown by the arrows in FIG. 5 by peripheral manual manipulation of the circle elements. As shown, each of the circles is rotatable seriatim with movement of the triangular elements and spacer elements to any of the circles while the central elements 1, 10 and 20 remain fixed. For example, triangular element 2 with layer 2*abc* (shared by all three circles) is immediately rotatably moved by rotation of any of circles A, B and C. Triangular element 2 with layer 2*ac* and spacer element 3 with layer 3*ac* (shared by circles A and C) are immediately rotatably moved by rotation of either circle A or C. Triangular element 2 with layer 2*ab* and spacer element 3 with layer 3*ab* (shared by circles A and B) are immediately rotatably moved by rotation of either circle A or B. Triangular element 2 with layer 2*bc* and spacer element 3 with layer 3*bc* (shared by circles B and C) are immediately rotatably moved by rotation of either circle B or C. Thus, by selective seriatim rotational movements of the the circles any triangular element or spacer element can be moved to any other position of any of the overlapping circles. However, since the circle members are rotated as units, movement of one triangular or spacer element, of necessity cause the movement of the other elements of the rotating circle. With varying colors, and external shapes or configurations of the various movable elements it is necessary to follow a rigorous series of alternate rotations of the various circles in order to achieve the desired color combination or shape configuration.

In the simpler representational embodiment shown in FIG. 8, two circles 5 and 6 of different diameters are overlapped to form an overlapping portion 5–6. Circles 5 and 6 are individually rotatable in the direction shown by the arrows. Portions 5*a*, 5*b*, and 5*c* of circle 5 and portions 6*a* and 6*b* of circle 6 (as well as overlapping portion 5–6) can be rotated into any of the other positions shown. Because of the difference of diameter of circles 5 and 6, the inner curvature of each of such portions must correspond to the outer curvature of the other circle in order for such portions to be transferrable between the circles.

It is understood that the specific embodiments described above are representative of the present invention and are not to be construed as being limitations of the present invention. It is understood that changes of structure, size and interrelations of circle parts such as providing the overlapping structures with folding parts for storage, or providing adjacent parts with spring loaded abuttments for elimination of slop in movement, may be made without departing from the scope of the present invention as defined by the following claims.

What is claimed is:

1. An amusement device comprised of two or more interlocked circle members positioned along a common plane and having substantially parallel central axes, with each of the circle members being comprised of compositional elements which are rotatable around the central axis of the circle member, wherein a portion of the compositional elements of each of the circle members laterally overlaps a section of at least one other circle member along the common plane, whereby said portion is a common part of both the overlapping circle member and the circle member being overlapped, with each of the circle members being independently rotatable around its own central axis and with the compositional elements of the circle members being thereby rotatable into any or all of the overlapping circle members, wherein each of the circle members is comprised of a fixed central element having the central axis passing therethrough and the circle members further having at least three compositional elements interlocked with the fixed central element and rotatable therearound, whereby the compositional elements are rotatable into the overlapping portions; wherein the fixed central element, and compositional elements are each comprised of three layers, all substantially perpendicular to axes of the circle members, with each of the layers of each of the elements being laterally adjacently complementary in shape to co-planar layers of adjacent elements along said plane, and with the elements being thereby laterally co-fitted, whereby adjacent elements are axially interlocked, wherein the fixed central element is comprised of upper and lower layers connected by a central layer laterally radially extending along said plane from between the upper and lower layers; wherein the compositional elements are each comprised of upper and lower compositional element layers connected by a central compositional element layer extending inwardly from the peripheries of both of the upper and lower compositional element layers thereby defining a spacing between the upper and lower compositional element layers with the spacing being sized to accommodate a portion of the laterally radially extending central layer of the fixed central element therewithin; wherein the circle members have exposed outer peripheral edges which define the spacing between upper and lower compositional element layers, with a frame member closely encircling the exposed peripheral edges to maintain lateral interlocking of all of the elements, with the circle members being freely rotatable within the frame member; and wherein the frame member is sandwiched and fully contained within the spacing between upper and lower element layers of the compositional elements, with the outer peripheral edges remaining exposed for manual manipulation.

2. The amusement device of claim 1 comprising two circle members of different diameters wherein the overlapping portions of the circle members are comprised of compositional elements having an ovate configuration of two joined arcs, with a first of said arcs being equivalent to that of a subtended arc of one of the circle members and the other of said arcs being equivalent to a subtended arc of the other of the circle members whereby the overlapping portions are rotatable into each of the circle members.

3. The amusement device of claim 1 wherein the compositional elements differ in color or configuration whereby the device is utilizable as a puzzle wherein a specific relation between the differing compositional elements constitutes a pre-determined solution to the puzzle.

4. The amusement device of claim 1 wherein the amusement device is comprised of three circle members.

5. The amusement device of claim 1 wherein the circle members are further comprised of spacer elements positioned between the compositional elements, with the spacer elements being interlocked with the fixed central element and the compositional elements adjacent thereto, and with the spacer elements being rotatable around the fixed central element whereby the spacer elements are rotatable into each of the circle members.

6. The amusement device of claim 5 wherein the spacer elements are each comprised of three layers, all substantially perpendicular to axes of the circle members, with each of the layers of each of the elements being laterally adjacently complementary in shape, along said plane, to co-planar layers of adjacent elements, and with the elements being thereby laterally co-fitted, along said plane, whereby adjacent elements are axially interlocked.

7. The amusement device of claim 1 wherein the spacer elements are each comprised of upper and lower spacer element layers connected by a central layer with a portion of the spacer element central layer extending inwardly from the peripheries of both of the upper and lower spacer element layers, alone said plane, thereby defining a spacing between the upper and lower spacer element layers with the spacing being sized to accommodate a portion of the laterally radially extending central layer of the fixed central element therewithin and wherein a second portion of the spacer element central layer extends outwardly from between the upper and lower spacer element layers, alone said plane, for sized interfitting in a portion of the spacing between upper and lower compositional element layers of compositional elements adjacent to the spacer element.

8. The amusement device of claim 7 wherein the upper and lower layers of the compositional elements are each comprised of triangular shaped elements with each of the sides of the triangle being curved with a curvature equivalent to the curvature of the outer peripheral edges of the circle members to which it is movable.

9. The amusement device of claim 7 wherein the interfitted layers of the central fixed element, compositional elements and spacer elements have rounded corner edges to facilitate rotational movement of the compositional elements and spacer elements.

10. The amusement device of claim 7 wherein the device is adapted to permit additional circle members to be added by insertion of additional fixed central elements into an outer peripheral spacing between the upper and lower layers of existing compositional elements and upper and lower layers of existing spacer elements and the circular addition of alternating compositional and spacer elements around the additional fixed central element until an additional circle member is formed.

* * * * *